US006418864B1

(12) United States Patent
Piyasil et al.

(10) Patent No.: US 6,418,864 B1
(45) Date of Patent: Jul. 16, 2002

(54) INCINERATION PROCESS AND INCINERATOR USING HEAT GENERATED FROM COMBUSTION TO BAKE AND SUBLIMATE WASTE TO PRODUCE GASES USING AS FUEL FOR THE BURNING

(76) Inventors: Manop Piyasil; Somjit Piyasil, both of 11/14 Moo 8 Kanjanapisake Road, Bangkok 10160 (TH)

( * ) Notice: Subject to any disclaimer, the term of this patent is extended or adjusted under 35 U.S.C. 154(b) by 0 days.

(21) Appl. No.: 09/706,202

(22) Filed: Nov. 3, 2000

(51) Int. Cl.[7] ..... F23B 7/00; F23B 5/02; F23G 7/06; F23J 15/00

(52) U.S. Cl. ..... 110/342; 110/211; 110/223; 110/228; 110/229; 110/203; 110/212; 110/165 R

(58) Field of Search ..... 110/218, 219, 110/222, 223, 225, 227, 228, 229, 230, 231, 203, 342, 345, 251, 252, 210, 211, 212, 165 R, 166, 167; 431/5

(56) References Cited

U.S. PATENT DOCUMENTS 653,015 A * 7/1900 Besemfelder ..... 110/219
1,107,917 A * 9/1914 Derrick ..... 110/219
1,531,766 A * 3/1925 Trimborn et al. ..... 110/219
RE20,046 E * 7/1936 Hartley ..... 110/224
2,128,472 A * 8/1938 Raisch ..... 110/224
2,506,782 A * 5/1950 Fallon ..... 110/165 R
2,932,712 A * 4/1960 Levin ..... 219/19
3,566,809 A * 3/1971 Carry ..... 110/8
3,585,946 A * 6/1971 Dahlund ..... 110/8 R
3,680,503 A * 8/1972 Danielsson et al. ..... 110/13
3,707,129 A * 12/1972 Kawashimo et al. ..... 110/15
3,861,332 A * 1/1975 Itasaka ..... 110/8 C
4,046,086 A * 9/1977 von Dreusche ..... 110/12
4,048,927 A * 9/1977 Augustin et al. ..... 110/8 R
4,116,136 A * 9/1978 Mallek et al. ..... 110/251
4,262,611 A * 4/1981 Kuhnert et al. ..... 110/346
4,504,222 A * 3/1985 Christian ..... 432/139
4,516,511 A * 5/1985 Kuo ..... 110/346
4,531,462 A * 7/1985 Payne ..... 110/210
5,159,884 A * 11/1992 Malick ..... 110/223
5,231,936 A * 8/1993 Kikuchi et al. ..... 110/224
5,323,714 A * 6/1994 Cox ..... 110/229
5,477,790 A * 12/1995 Foldyna et al. ..... 110/346
6,305,302 B2 * 10/2001 Kleiss ..... 110/210
6,324,999 B1 * 12/2001 Maejima ..... 110/225

* cited by examiner

*Primary Examiner*—Ira S. Lazarus
*Assistant Examiner*—K. B. Rinehart
(74) *Attorney, Agent, or Firm*—Merchant & Gould PC

(57) ABSTRACT

An incineration process and an incinerator using heat generated from combustion to bake and sublimate waste to produce gas as for burning waste is designed to use heat generated from the gas as burning chamber in the baking process and to allow waste to emit inflammable gas to be used as fuel in the gas burning chamber without using any other kind of fuel. The baked waste will be burned until it becomes charcoal in the burning chamber while its ash will be continuously removed and more waste continuously fed into the burning chamber. With this process, high temperature, low pollution, and budget savings will result.

11 Claims, 2 Drawing Sheets

INCINERATION PROCESS AND INCINERATOR USING HEAT GENERATED FROM COMBUSTION TO BAKE AND SUBLIMATE WASTE TO PRODUCE GASES USING AS FUEL FOR THE BURNING

FIELD OF THE INVENTION

The present invention relates to a process and an apparatus for incineration waste. More particularly, the invention relates to an incineration process and an incinerator using heat generated from combustion to bake and sublimate waste to produce gases using as fuel for burning.

STATE OF ART OF THE INVENTION

The development of incinerators begins with a single compartment incinerator which usually consists of a burning chamber which injects fuel mixed with air into the chamber filled with waste. This kind of incinerator is still in use at present, especially the small-sized ones used in factories and hospitals. One problem with this kind of incinerator is that the temperature within the burning chamber, approximately 400–5000° C., is low so there will be polluting substants resulting from incomplete combustion. The cause of low temperature comes from the loss of heat in the burning chamber through the evaporation which takes place before the waste is dry and inflamed. Since this is a loss of energy, the later models of incinerators are composed of two separated burning chambers: waste burning chamber and gas burning chamber. The gas burning chamber added will make the inflammable gas created from the burning of waste burn at a higher temperature, which, in turn, makes the burning of waste more complete. At present, the two-chamber incinerator has the waste burning chamber and gas burning chamber completely separated from each other. As for the waste burning chamber, the heat generated will make waste dry and release inflammable gas. The reactions that take place, both the burning of already dry waste and the release of inflammable gas and heat, will be used in the subsequent evaporation process and the release of gas. These reactions lower the temperature, so gasoline is needed to raise the temperature to the appropriate level. Some part of inflammable gas generated will be burned in the process. The rest will be passed to the gas burning chamber. However, the concentration of the gas is not high enough to ignite the flame, so fuel is needed to increase the temperature to the appropriate level) for burning and destroying poisonous gas that results, loss of energy.

Technical nature of the invention

In view of the foregoing, the present invention has been made, and an object of the invention is to provide an incinerator which uses heat generated from combustion to bake and sublimate waste to create gas for burning. Said incinerator is particularly designed to allow waste inside the incinerator to receive the heat generated from combustion to bake and sublimate waste to create gas which is then used as fuel for the incineration. The waste-baking chamber formed into a cylindrical shape and the gas combustion chamber is a duct located in the middle of the waste-baking chamber. This is designed so that the baking process and the burning process of waste can be separated from each other. The waste which has already been baked is burned in the charcoal burning chamber which is at the bottom and formed in to a conical shape connected to the waste-baking chamber. It is also supported by the bottom grate which is characterized by grates assembled into an overturned cone. Inflammable gas will be drawn through the gas duct to be used in the burning of waste in the burning chamber. The burning process using inflammable gas will not be combined with the burning of waste in the burning chamber. As a result, inflammable gas will be totally used in the burning chamber without the use of any other fuel because there will be a sufficient quantity of gas needed. High heat generated from the burning of gas will be used in the baking process& without complicated equipment required. Further, the ash from the burning chamber will fall from the bottom grate to the ash collecting tray by jet pulse of compressed air at regular intervals.

In addition, the invention also provides an incineration process operate consistently with less emission gases at the initial stage. The initial step requires the use of gasoline to make the temperature high enough to bake the waste until dry enough to release inflammable gas. After that, gasoline is no longer needed. The burning of baked waste that releases inflammable gas is similar to the burning of charcoal in which less polluting gas generated because of the high temperature in the incinerator.

BRIEF DESCRIPTION OF THE DRAWINGS

In the complete disclosure of the incinerator in this invention, the composition of the incinerator will be illustrated as follows.

DETAILED DESCRIPTION OF THE PREFERRED EMBODIMENTS

Hereinafter, an incinerator according to a preferred embodiment of the present invention will be described with reference to the drawings.

Figure 1:
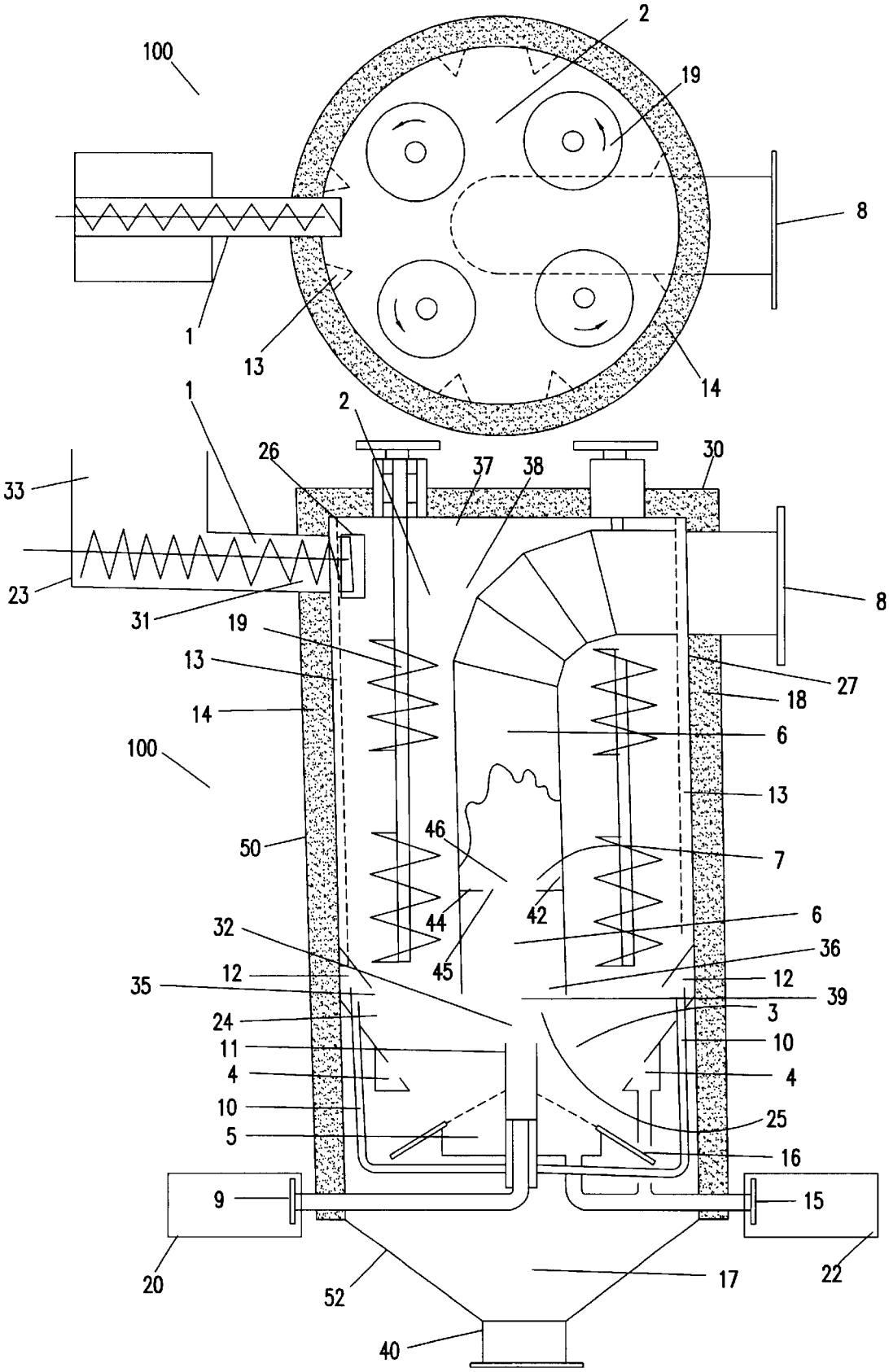
FIG. 1: Illustration of a small-sized incinerator.
Figure 2:
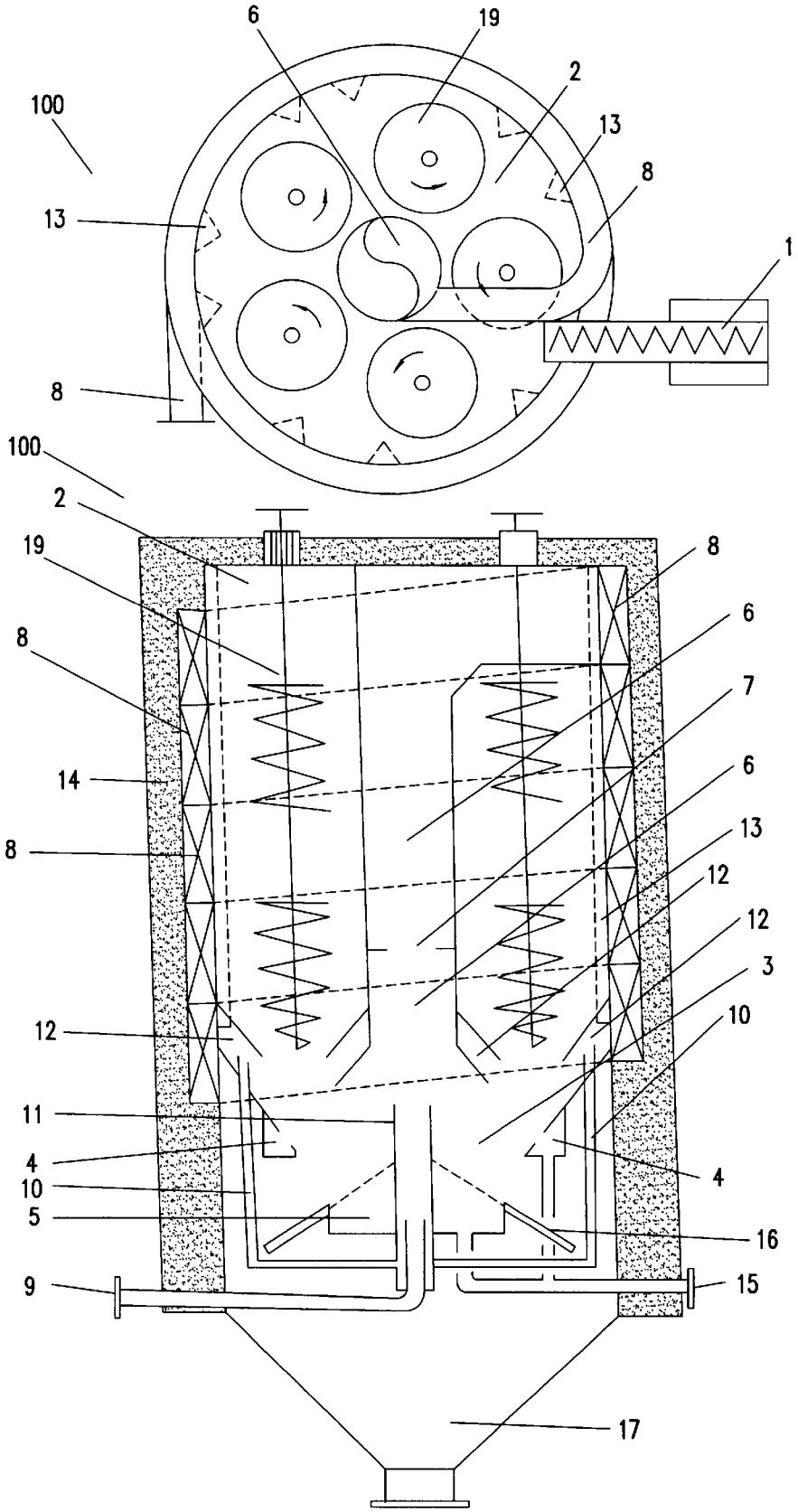
FIG. 2: Illustration of a large-sized incinerator.

The materials used in the assembly of the incinerator consist of heat and corrosion resistant metal. As shown in FIGS. 1 and 2, waste will be fed through the top of the incinerator with the screw feeder 1, the screw is connected to a motor at the end of the tube, while the other end of the screw does not reach the other end of the tube, thus leaving space to compact waste before put out into the incinerator. That is to prevent the back flow of vapor and gas through the screw. Waste will be fed into the waste-baking chamber 2 which formed into a cylindrical shape. In the middle of the baking chamber, there is a gas burning chamber 6 which is a vertical duct located at the center of the waste-baking chamber 2 to generate heat used in the baking process. The charcoal-burning chamber 3 is connected to the waste-baking chamber 2. Its bottom part formed into a conical shape to force waste into the middle, right beneath the middle duct which acts as a gas burning chamber 6. Waste in the charcoal-burning chamber 3 will fall onto the bottom grate 5 which is circular in shape, with the top part shaped like a funnel 16 and connected to the bottom grate 5 whose teeth are tilted at 30 to 35° to allow ashes to easily move from the charcoal burning chamber 3, with the jet pulse of compressed air, to the ash collecting tray 17, a funnel at the bottom of the incinerator.

In this process, the primary air is generated from the first air blower (not shown) to the first air duct 15 which separates air into two parts: that sent to the bottom grate 5, a funnel with air hole on the top; and, that sent to the side grate 4 connected to the funnel collecting waste from the waste-baking chamber 2. At the bottom edge, there is room for air to circulate and air-feeding holes around it.

The secondary air comes from the second air blower (not shown) to the second air duct 9, and it will be injected into the gas burning chamber 6, passed through the main duct 11 connected to the gas sucking duct 10 which sucked the gas and vapor from collecting compartment 12. Because the gas and vapor collecting compartment is an overturned funnel above the side grate 4, there is an empty space between the gas and vapor collecting compartment and the side grate. As the secondary air is injected into the gas burning chamber 6, the velocity of the air in the duct 9 will create the venturi principle in the main duct 11 which results in gas and vapor being sucked from the waste baking chamber 2 through the gas collecting duct 13, a welded duct running along the top of the waste baking chamber 2, to the gas collecting compartment 12. Gas and vapor will then be sucked through the gas sucking duct 10 to the main duct 11 and subsequently injected into the gas burning chamber 6 together with secondary air for combustion.

The gas burning chamber 6 is a vertical duct with the bottom end located on the top of the charcoal burning chamber 3 and placed at the center of the waste baking compartment 2. Inside the gas burning chamber 6, at the bottom there is an orifice plate 7 which is a ring with the outer part welded with the inner part of the duct, thus leaving a smaller hole in the middle to reduce the cut surface of the chamber 6. This enables the gas and air to mix well which, in turn, leads to a more complete combustion, as well as increases the temperature of the burning process. The burning of gas will continuously take place in the gas burning chamber 6, for the incinerator with a too small waste baking chamber 2 (as shown in FIG. 1), the gas will be released outside. But, if the waste baking chamber 2 is large, hot gas will be passed through the hot gas duct 8 welded into the outer side of the baking chamber 2 (as shown in FIG. 2) to increase the effectiveness of the baking process. Inside the waste-baking chamber 2, there is a waste-stirring machine 19 which is a screw connected to 4 or more long axles that run from the top to the bottom of the waste-baking chamber 2. This waste-stirring machine 19 stirs the waste in the waste baking chamber 2 to increase the efficiency of the baking process. The outer part of the incinerator will be insulated 14 to prevent loss of heat.

During start up the incinerator, fuel is used to ignite the combustion. It will be sent through a duct and injected to the top of the main duct 11. As the ignition starts, the fuel will be burned in the gas burning chamber 6 until it reaches the temperature of approximately 800 to 9000° C. The waste will continuously emit inflammable gas which will then flow to the gas burning chamber 6. When the temperature in the gas burning chamber increases, the injection of fuel will be stopped.

While the preferred embodiment of the present invention has been described using specific terms, such description is for illustrative only, and it is to be understood that changes and variation may be made without departing from the spirit or scope of the following claims.

What is claimed is:

1. An incineration process using heat generated from combustion to bake and sublimate waste to produce gas for burning waste, comprising the steps of:

feeding waste by a waste-feeding means (1) on a top (30) of an incinerator (100) and compacting the waste before sending the waste into the incinerator (100);

feeding fuel and injecting the fuel to a top of a main duct (11), igniting the fuel and burning the waste in a gas burning chamber (6) until an inflammable gas is generated from the waste and increasing the temperature in the gas burning chamber that is sufficient for burning the inflammable gas in the gas burning chamber (6), then breaking off the fuel;

baking waste in a waste-baking chamber (2) by burning said inflammable gas in the gas burning chamber (6) to generate heat used in a baking process;

burning baked waste in a burning process in a charcoal burning chamber (3) which is connected to the waste-baking chamber (2);

forcing waste into a middle (32) of the charcoal-burning chamber (3), so that waste may fall onto a bottom grate (5) to an ash collecting tray (17) at a bottom (40) of the incinerator (100).

2. A process according to claim 1, further comprising a step of stirring waste by a stirring means (19) in the waste-baking chamber (2) to increase the efficiency of the baking process.

3. A process according to claim 1, wherein the burning process of the inflammable gas generated from the waste in the gas burning chamber (6) comprises steps of:

blowing primary air from a first air blower (22) to a first duct (15), and separating the primary air into two parts: a first-part is sent to a bottom grate (5), and a second-part is sent to a side grate (4) connected to a funnel (24) collecting waste from the waste-baking chamber (2); where at a bottom edge (25), there is room for air to circulate around the waste-baking chamber (2);

blowing secondary air from a second air blower (20) to a second air duct (9) and injecting the secondary air into the gas burning chamber (6), passing through the main duct (11) connected to a gas sucking duct (10) which sucked gas and vapor from a collecting compartment (12), then the gas and vapor being sucked from the waste-baking chamber (2) through a gas collecting duct (13) to the main duct (11) and then being subsequently injected into the gas burning chamber (6) together said secondary air, mixing gas and air with an orifice plate (7) to complete combustion and increase a temperature of the burning process in the gas burning chamber (6), such as that hot gas escapes through a hot gas duct (8).

4. A process according to claim 3, wherein hot gas escapes through the hot gas duct (8) welded into an outer side (27) of the waste-baking chamber (2) to increase the effectiveness of the baking process.

5. An incinerator (100) using heat generated from combustion to bake and sublimate waste to produce gas for burning waste in a burning process, comprising:

a waste-feeding means (1) disposed on a top (30) of said incinerator (100) for feeding and compacting the waste;

a waste-baking chamber (2) having a gas burning chamber (6) located at a center (38) of the waste-baking chamber (2) to generate heat used in baking process;

a charcoal-burning chamber (3) is connected to the waste-baking chamber (2);

an ash collecting tray (17) at a bottom (40) of the incinerator;

a first air blower (22) connected to a first air duct (15) which is separated into two ducts; one duct connected to a bottom grate (5) and another duct connected to a side grate (4), in turn, said side grate (4) being operatively connected with a gas and vapor collecting compartment (12), the gas and vapor collecting compartment (12) operatively connected with the waste-baking chamber (2) and collects waste from waste-baking chamber (2); where at a bottom (25) of the waste-baking chamber (2), there is room for air to circulate and air-feeding holes around the waste-baking chamber (2);

a second air blower (20) connected to a second air duct (9), the second air duct (9) being operatively connected to the gas burning chamber (6), the second air duct feeding secondary air into the gas burning chamber (6) the secondary air passing through a main duct (11) connected to a gas sucking duct (10), the gas sucking duct (10) being operatively connected to the gas and vapor collecting compartment (12); the gas sucking duct sucks gas and vapor from the gas and vapor collecting compartment (12); the gas and vapor collecting compartment (12) being a funnel (24) above the side grate (4); wherein between the gas and vapor collecting compartment (12) and the side grate (4) there is an empty space (35); the secondary air is injected into the gas burning chamber (6) where a velocity of the air in the second air duct (9) will create the venturi principle in the main duct (11) which results in gas and vapor being sucked from the waste baking chamber (2) through a gas collecting duct (13), the waste-baking chamber (2) being operatively connected with the gas collecting duct (13), the gas collecting duct (13) running along a top (37) of the waste baking chamber (2), the gas collecting duct (13) being operatively connected with the gas and vapor collecting compartment (12), the gas and vapor is sucked through the gas sucking duct (10) to the main duct (11) and subsequently injected into the gas burning chamber (6) together with the secondary air for combustion; and fuel used to ignite combustion, the fuel being injected to a top of the main duct (11).

6. An incinerator according to claim 5, wherein said waste-feeding means (1) is a duct including a screw that is used to feed waste; wherein one end of the screw is connected to a motor (26) at an end (31) of a tube (23), while another end (33) of the screw extending toward the end (31) of the tube (23) and leaving space to compact waste before sending the waste into the incinerator (100) to prevent loss of vapor and gas.

7. An incinerator according to claim 5, wherein said waste-baking chamber (2) is a cylindrical tank and said burning chamber (6) is a vertical duct.

8. An incinerator according to claim 5, wherein said gas burning chamber (6) is a vertical duct with a bottom end (36) located on a top (39) of the charcoal burning chamber (3) and placed at the center (38) of the waste baking chamber (2), inside the gas burning chamber (6) at the bottom end (36) there is an orifice plate (7) which is a ring with an outer part (44) welded with an inner part (42) of the gas burning chamber, leaving a smaller hole (45) in a middle (46) to reduce a cut surface of the chamber (6) and enables gas and air to mix which leads to a more complete combustion, and increase a temperature of the burning process; the burning of gas will continuously take place in the gas burning chamber (6).

9. An incinerator according to claim 5, wherein a hot gas duct (8) is welded into an outer side (27) of the waste-baking chamber (2) to increase the effectiveness of the baking process.

10. An incinerator according to claim 5, wherein a waste-stirring machine (19) which is a screw connected to four or more long axles that run from the top (37) to a bottom edge (25) of the waste-baking chamber (2) wherein the waste-stirring machine (19) stirs the waste in the waste-baking chamber (2) to increase the efficiency of the baking process.

11. An incinerator according to claim 5, wherein an outer part of the incinerator (50) is insulated to prevent loss of heat.

* * * * *